US005586577A

United States Patent [19]

Cho

[11] Patent Number: 5,586,577

[45] Date of Patent: Dec. 24, 1996

[54] MONO-BLOCK CONTROL VALVE WITH SIDE BYPASS PASSAGE

[75] Inventor: Hyung J. Cho, Changwon, Rep. of Korea

[73] Assignee: Samsung Heavy Industries Co., Ltd., Seoul, Rep. of Korea

[21] Appl. No.: 497,628

[22] Filed: Jun. 30, 1995

[30] Foreign Application Priority Data

Sep. 28, 1994 [KR] Rep. of Korea ..... 94-24400
Sep. 29, 1994 [KR] Rep. of Korea ..... 94-24709

[51] Int. Cl.[6] ..... E03B 1/00
[52] U.S. Cl. ..... 137/596.13
[58] Field of Search ..... 137/596.13

[56] References Cited

U.S. PATENT DOCUMENTS 3,225,781 12/1965 Kruger et al. ..... 137/596.13 X
4,080,994 3/1978 Flaschar et al. ..... 137/596.13
4,099,541 7/1978 Binkley et al. ..... 137/596.13
4,150,690 4/1979 Heiser et al. ..... 137/596.13

FOREIGN PATENT DOCUMENTS 1129777 1/1957 France ..... 137/596.13

*Primary Examiner*—Hoang Nguyen
*Attorney, Agent, or Firm*—Kenyon & Kenyon

[57] ABSTRACT

An improved mono-block control valve having a side bypass passage substituting for a typical center bypass passage is disclosed. The side bypass passage simplifies the passage structure of the valve body into a two-dimensional structure, thereby remarkably reducing the valve body size and improving the space efficiency and cutting down the cost. The left and right return passes are connected together by a connection passage at every section of the valve body. Due to the connections passages, the control valve prevents passage resistance and pressure loss in the return passages and makes both the negative pressures in the right and left actuator ports and the negative pressures in the sections uniform. The control valve thus improves the operational stability and reliability.

2 Claims, 3 Drawing Sheets

MONO-BLOCK CONTROL VALVE WITH SIDE BYPASS PASSAGE

BACKGROUND OF THE INVENTION

1. Field of the Invention

The present invention relates in general to a mono-block control valve used in hydraulic circuits and, more particularly, to a structural improvement in such a valve for substituting a side bypass passage for the typical center bypass passage, thereby improving the space efficiency of the valve and for connecting the right and left return passages to each other using the surplus space provided due to the side bypass passage and thereby reducing the passage resistance and achieving the stable operation of the valve.

2. Description of the Prior Art

In varieties of hydraulic power machines such as construction heavy equipment, the actuators are operated by pressurized oil delivered from a hydraulic pump. The actuators are thus provided with their control valves.

The mono-block control valve integrates the control valves for the actuators into a single body. The passages for connecting the control valves are formed in the single body of the mono-block control valve so that the mono-block control valve can simplify the valve structure, achieve the recent trend of compactness of the valves and remarkably improve the durability of the valves. Furthermore, as the mono-block control valve can be exclusively used differently from the separated control valves commonly used, the mono-block control valve has been widely used.

With reference to FIGS. 1 and 2, there is shown an example of the typical mono-block control valves. FIG. 1 is a longitudinally sectioned view of the control valve, while FIG. 2 is a cross sectioned view of the valve taken along the section line 2—2 of FIG. 1. As shown in the drawings, the mono-block control valve has a plurality of sections S1, S2 and S3, corresponding to control valves for the actuators respectively, in a single valve body B. When the spool (not shown) of a section, for example, the first section S1, is placed in its neutral position, the pressurized oil is transmitted to a next section, for example, the second section S2, through a first bridge 106*a*. The center of the valve body B is provided with a center bypass passage 101 which is used for returning the pressurized oil to a return tank T without resistance when the spools of all the sections S1, S2 and S3 are placed in their neutral positions. When at least one of the spools of the sections S1, S2 and S3 moves, the center bypass passage 101 will be shut down. The valve body B also includes a parallel passage 103 for supplying the pressurized oil to the sections S1, S2 and S3 in parallel. The passage 103 is formed in the body D such that the passage 103 passes all of the sections S1, S2 and S3. The pressurized oil delivered from the pump P is supplied to or discharged from the left and right actuator ports 104 and 104' from or to the parallel passage 103 through a second bridge 106*b*. The pressurized oil discharged from the left and right actuators ports 104 and 104' returns to the return tank T through return passages 105 and 105' formed in the opposite outermost portions of the valve body B.

However, the above mono-block control valve has a problem in that the valve B has five pump lines, which makes the passage Structure of the body B a complicated three-dimensional structure. Another problem of the above control valve is resided in that the valve necessarily has the bridges 106*a* and 106*b*, connecting the pump lines, and thereby enlarging the valve body size and increasing the cost.

The left and right return passages 105 and 105' passes the sections S1 and S2 and in turn are connected to each other through a connection passage 107 in the last section S3.

Therefore, the total length of the return passages 105 and 105' of the above mono-block control valve lengthens to increase the total passage resistance. In addition, there is a negative pressure difference between the left and right return passages 105 and 105' because the lengths of the return passages 105 and 105 extending from the actuator ports 104 and 104' to the return tank T are different from each other. For example, in the case of the first section S1, the oil discharged from the right actuator port 104' rapidly returns to the tank T simply through the return passage 105' with little resistance. However, the oil discharged from the left actuator port 104 returns to the return tank T through a longer passage. That is, the oil passes through return passage 105 extending in the sections S1 and S2 and in turn flows in the connection passage 107, making the two return passages 105 and 105' meet one another. Thereafter, the oil returns to the tank T through the return passage 105'. Such a difference between the lengths of the return passages can not help causing the negative pressure difference between the two return passages 105 and 105'. The above control valve also causes pressure loss and unstable operation because the negative pressure in a specified section having a relatively longer return passage is remarkably higher than those of the other sections.

SUMMARY OF THE INVENTION

It is, therefore, an object of the present invention to provide an improved mono-block control valve in which the above problems can be overcome and which has a side bypass passage suitable for simplifying the passage structure of the valve body into a two-dimensional structure, thereby remarkably reducing the valve body size and improving the space efficiency and cutting down the cost.

It is another object of the present invention to provide an improved mono-block control valve which prevents passage resistance and pressure loss in the return passages and makes both the negative pressures in the right and left actuator ports and the negative pressures in the sections of the valve body uniform, thereby improving the operational stability and reliability of the mono-block control valve.

To achieve the first object, the present invention provides a mono-block control valve having a plurality of sections corresponding to control valves in a body and applying the pressurized oil of a hydraulic pump to a plurality of actuators through the sections, comprising: a parallel passage adapted for supplying the pressurized oil of the pump to the sections in parallel, the parallel passage being formed in the valve body such that the parallel passage passes the centers of all the sections; right and left actuator ports formed in the valve body at opposite sides of the parallel passage such that the actuator ports selectively communicate with the parallel passage in accordance with spool movement; right and left return passages formed in the valve body at the outside of the actuator ports respectively and adapted for returning the pressurized oil, coming out of the actuators, to a return tank; and a bypass passage formed in the valve body at the outside of either return passage such that the bypass passage passes all the sections, the bypass passage being selectively opened to return the pressurized oil of the pump to the return tank when a spool of each section is placed in its neutral position but shut down when the spool of each section moves.

In the above mono-block control valve, the prior art center bypass passage is substituted with the side bypass passage formed in either outermost portion of the valve body. Therefore, this control valve removes the bridge, which is formed in a typical mono-block control valve for connecting the parallel passage to the actuator ports, from the valve body and thereby simplifying the passage structure in the valve body and remarkably reducing the valve body size.

To achieve the second object, the mono-block control valve of the invention further includes a connection passage which connects the right and left return passages together at every section.

The connection passages remarkably reduce the passage lengths from the sections to the return tank and make both the negative pressures in the actuator ports and the negative pressures in the sections almost completely equal to each other. Therefore, the control valve remarkably improves operational stability and reliability.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
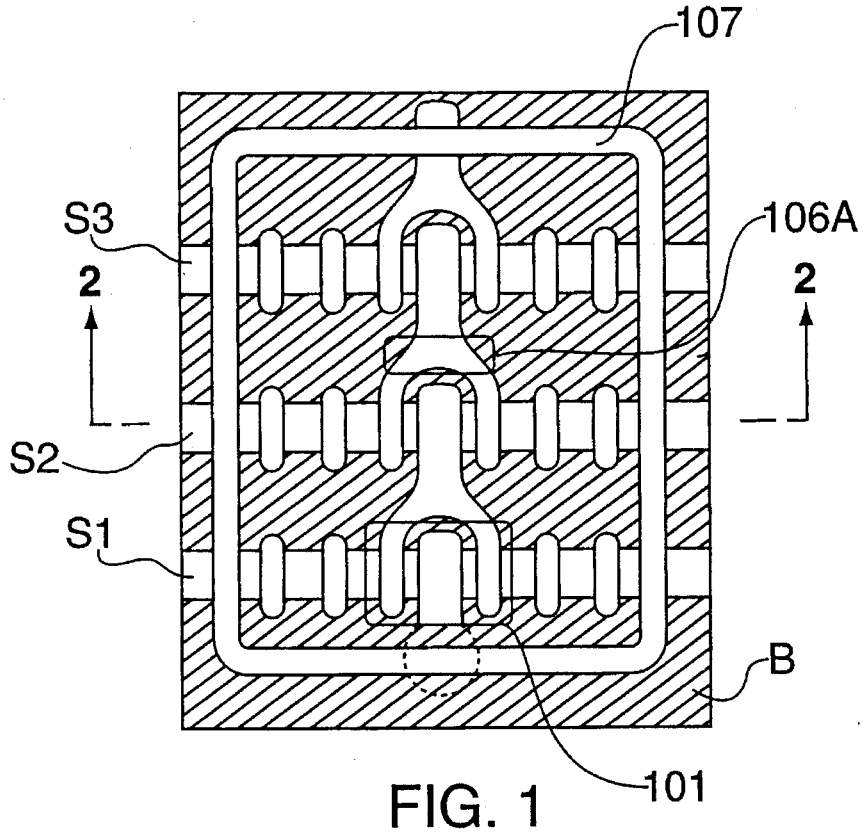
FIG. 1 PRIOR ART
FIG. 1 is a longitudinally sectioned view of a typical mono-block control valve with a center bypass passage.
Figure 2:
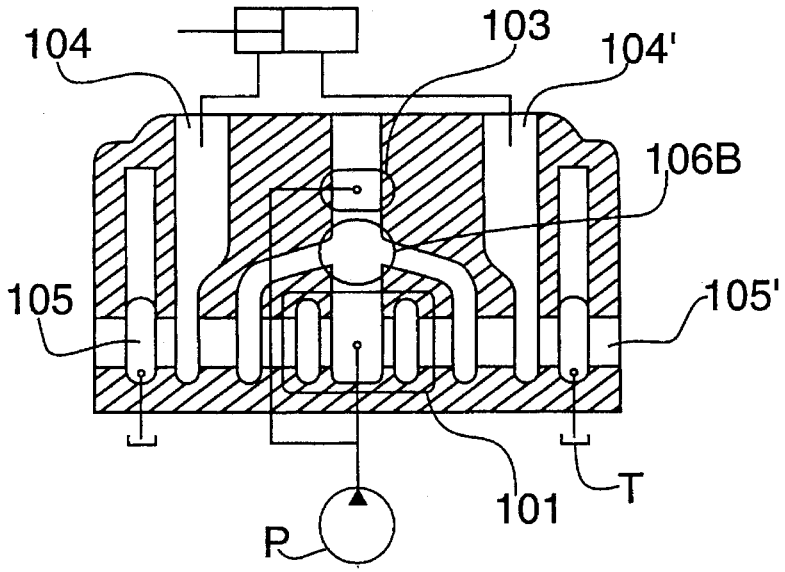
FIG. 2 PRIOR ART
FIG. 2 is a cross sectioned view of the typical control valve taken along the section line 2—2 of FIG. 1.
Figure 3:
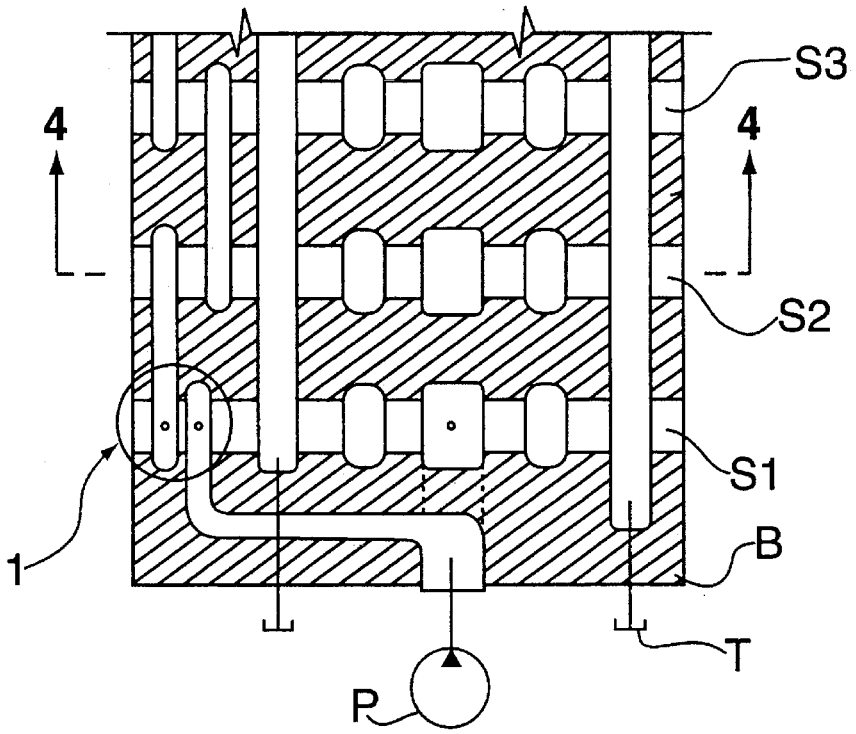
FIG. 3 is a longitudinally sectioned view of a mono-block control valve in accordance with an embodiment of the present invention.
Figure 4:
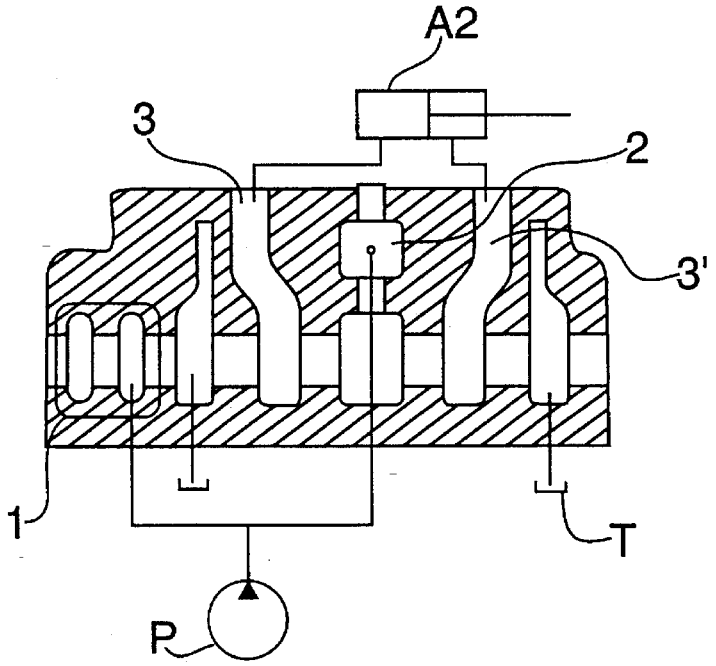
FIG. 4 is a cross sectioned view of the control valve taken along the section line 4—4 of FIG. 3.

FIGS. 3 and 4 show a mono-block control valve in accordance with an embodiment of the present invention. As shown in the drawings, a plurality of sections S1, S2 and S3 are formed in a single valve body B, which is a casted body. The sections S1, S2 and S3 correspond to control valves for supplying the pressurized oil of a hydraulic pump P to their associated actuators. One actuator A2 is shown in FIG. 4. The valve body B also includes a parallel passage 2 for supplying the pressurized oil of the pump P to the sections S1, S2 and S3 in parallel. The passage 2 is formed in the body D such that the passage 2 passes the centers of all the sections S1, S2 and S3. Left and right actuator ports 3 and 3' are formed in the valve body B at the opposite sides of the parallel passage 2. When the spool (not shown) of a section moves, the pressurized oil of the parallel passage 2 is supplied to an associated actuator A2 through an associated actuator port, for example the port 3. The oil coming out of the actuator A2 is returned to the return tank T through the other actuator port 3'. Return passages 4 and 4' are formed in the valve body B at the outside of the actuator ports 3 and 3' respectively. The return passages 4 and 4' extend to the return tank T after passing through the sections S1, S2 and S3. The valve body B also includes a side bypass passage 1 which is formed in the outermost portion of either side of the body B. That is, the side bypass passage 1 is formed in the body 1 at the outside of either return passage 4 or 4'. In the same manner as described for the prior art center bypass passage 101, the side bypass passage 1 of this invention is formed in the body B such that the passage 1 passes all the sections S1, S2 and S3. When the spool of a section, for example the section S1, is placed in its neutral position, the side bypass passage 1 transmits the pressurized oil of the pump P to a next section, for example S2. When the spools of all the sections S1, S2 and S3 are placed in their neutral positions, the side bypass passage 1 returns the pressurized oil to the return tank T without resistance. When at least one of the spools of the sections S1, S2 and S3 moves, the side bypass passage 1 will be shut down in that section. In this case, the pressurized oil is transmitted to either actuator port 3 or 3' through the parallel passage 2 of the section whose spool moves. The side bypass passage 1 is formed in the body B such that the passage 1 passes zigzag through the sections S1, S2 and S3 as best seen in FIG. 3.

The operational effect of the above mono-block control valve will be described hereinbelow.

The pressurized oil delivered from the pump P is supplied to the parallel passage 2 and to the bypass passage 1. When the spools of all the sections S1, S2 and S3 are placed in their neutral positions, the pressurized oil of both the side bypass passage 1 and parallel passage 2 is returned to the return tank T after passing through the sections S1, S2 and S3. When at least one of the spools of the sections, for example the spool of the section S2, moves, the pressurized oil of the parallel passage 2 of the section S2 is supplied to an associated actuator A2 through one of the actuator ports, for example the port 3. The oil in turn comes out of the actuator A2 through the other actuator port 3'. The oil, coming out of the actuator A2 through the other actuator port 3', is returned to the return tank T through the return passage 4'. As the side bypass passage 1 is shut down by the moved spool in this case, the oil can not transmitted to a next section through the bypass passage 1.

In the above mono-block control valve, the prior art center bypass passage is substituted with the side bypass passage. Therefore, the valve body of this control valve does not need to have a bridge which is used for connecting the parallel passage to the left and right actuator ports while getting out of the center bypass passage. As the above valve body has no bridge differently from the prior art mono-block control valve body the passage structure of the valve body can be remarkably simplified. Furthermore, the typical three-dimensional passage structure of the valve body can be preferably submitted with a two-dimensional passage structure. The number of the passages of the valve body can be remarkably reduced, the mono-block control valve of this invention remarkably simplifies its construction and cuts down the production cost. As the typical bridge is removed from the valve body of this invention, the size of the valve body, that is, the body height, is be reduced. The space efficiency of the valve body can be thus improved. When the valve body size is not reduced, the surplus space defined in the valve body because of removing the bridge can be used for varieties of uses.

Figure 5:
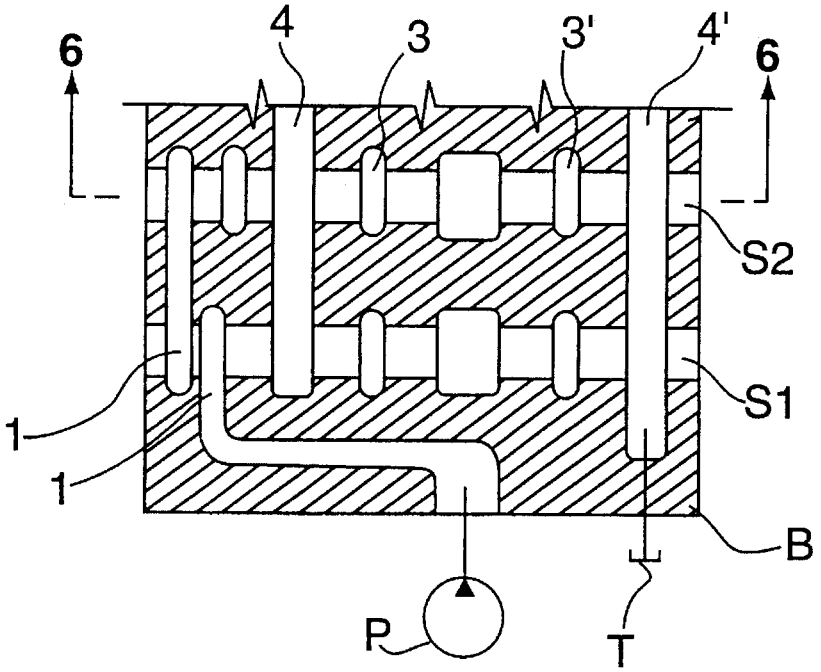
FIG. 5 is a longitudinally sectioned view of a mono-block control valve in accordance with another embodiment of the present invention.
Figure 6:
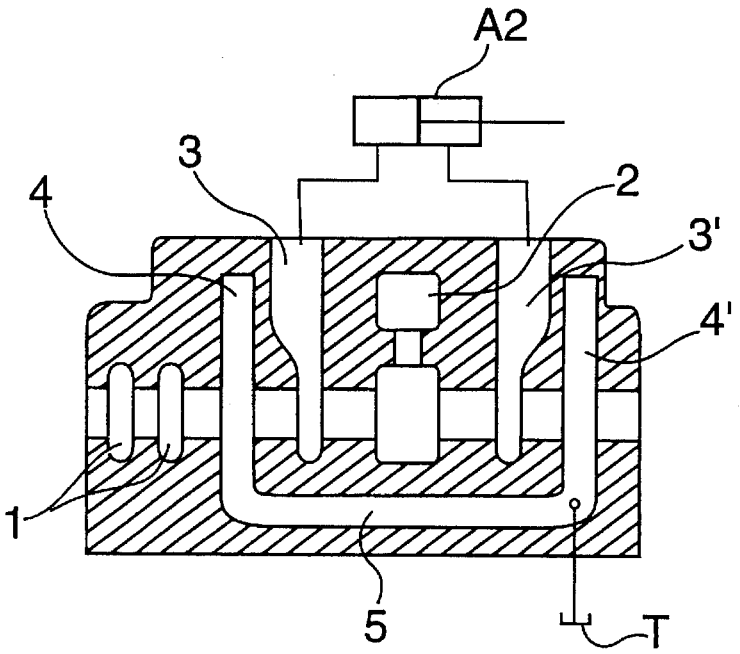
FIG. 6 is a cross sectioned view of the control valve taken along the section line 6—6 of FIG. 5.

FIGS. 5 and 6 shows a mono-block control valve in accordance with another embodiment of the present invention. In this embodiment, the left and right return passages 4 and 4' are connected together using the surplus space defined in the valve body because of removing the bridge from the valve body.

As shown in the drawings, a plurality of sections S1 and S2, corresponding to control valves for supplying the pressurized oil of the hydraulic pump P to their associated actuators, are formed in the single valve body B, which is a casted body. The valve body B also includes a parallel passage 2 for supplying the pressurized oil of the pump P to the sections S1 and S2 in parallel. The passage 2 is formed in the body D such that the passage 2 passes the centers of the sections S1 and S2. Left and right actuator ports 3 and 3' are formed in the valve body B at the opposite sides of the parallel passage 2. When the spool (not shown) of a section moves, the pressurized oil of the parallel passage 2 is supplied to an associated actuator A2 through an associated actuator port, for example the port 3. The oil coming out of the actuator A2 is returned to the return tank T through the other actuator port 3', left and right return passages 4 and 4' are formed in the valve body B at the outside of the actuator ports 3 and 3' respectively. The return passages 4 and 4' extend to the return tank T after passing through the sections S1 and S2. The left and right return passages 4 and 4' are connected together at every section by means of a connection passage 5.

In the another embodiment, the operation and construction of the side bypass passage 1 are same with those of the primary embodiment of FIGS. 3 and 4 and further explanation is thus not deemed necessary.

In the above another embodiment, the left and right return passages 4 and 4' are connected together at every section S1, S2 by means of the connection passage 5 using the surplus space defined in the valve body B due to the side bypass passage 1 substituting for the prior art center bypass passage. The passage lengths from the actuator ports 3 and 3' of each section to the return tank T are remarkably reduced. The control valve of this embodiment thus reduces both the passage resistance and the pressure loss. In addition, the passage lengths from the actuator ports 3 and 3' to the tank T of this embodiment are nearly equal to each other. Hence, there is no difference of negative pressure between the two actuator ports 3 and 3'. Another advantage of this embodiment is resided in that there is no section having a remarkably longer return passage than the other sections. In this regard, the difference of negative pressure between the sections can be almost completely removed.

As described above, the mono-block control valve of this invention has the side bypass passage, substituting for the typical center bypass passage, and removes the typical bridge from the valve body, thus to simplify the passage structure in the valve body and reduce the valve body size. The above control valve thus improves the space efficiency and cuts down the production cost and provides a surplus space which can be used for varieties of uses.

In addition, the left and right return passages of this control valve are connected together at every section by means of a connection passage using the surplus space. Both the passage resistance and the pressure loss in each return passage can be thus remarkably reduced. The connection passages also make both the negative pressures in the left and right actuator ports and the negative pressures in the sections almost completely equal to each other. Therefore, the control valve of this invention remarkably improves the operational stability and reliability.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A mono-block control valve having a plurality of sections corresponding to control valves in a body and applying the pressurized oil of a hydraulic pump to a plurality of actuators through the sections, comprising:

a parallel passage adapted for supplying the pressurized oil of the pump to the sections in parallel, said parallel passage being formed in the valve body such that the parallel passage passes the centers of all the sections;

right and left actuator ports formed in the valve body at opposite sides of the parallel passage such that the actuator pores selectively communicate with said parallel passage in accordance with spool movement;

right and left return passages formed in the valve body at the outside of said actuator ports respectively and adapted for returning the pressurized oil, coming out of said actuators, to a return tank;

a bypass passage formed in the valve body at the outside of either return passage such that the bypass passage passes all the sections, said bypass passage being selectively opened to return the pressurized oil of the pump to the return tank when a spool of each section is placed in its neutral position but shut down when the spool of each section moves; and a connection passage connecting the right and left return passages together at every section.

2. The mono-block control valve according to claim 1, wherein said bypass passage passes zigzag through said sections.

* * * * *

UNITED STATES PATENT AND TRADEMARK OFFICE

CERTIFICATE OF CORRECTION

PATENT No. : 5,586,577

DATED : December 24, 1966

INVENTOR(S) : Hyung J. Cho

It is certified that error appears in the above-identified patent and that said Letters Patent is hereby corrected as shown below:

Column 1, line 64, "Structure" should be -- structure --.

Column 6, line 30, "pores" should be -- ports --.

Signed and Sealed this

Thirteenth Day of January, 1998

Bruce Lehman

*Attest:*

BRUCE LEHMAN

*Attesting Officer*

*Commissioner of Patents and Trademarks*